US005779025A

United States Patent [19]

Dangelmayr et al.

[11] Patent Number: 5,779,025

[45] Date of Patent: Jul. 14, 1998

[54] THREE-DIMENSIONAL GRIPPER RAIL DRIVE APPARATUS

[75] Inventors: Andreas Dangelmayr, Ottenbach; Karl Thudium, Waeschenbeuren, both of Germany

[73] Assignee: Schuler Pressen GmbH & Co., Germany

[21] Appl. No.: 514,985

[22] Filed: Aug. 14, 1995

[30] Foreign Application Priority Data

Aug. 13, 1994 [DE] Germany ..... 44 28 772.0

[51] Int. Cl.[6] ..... B65G 25/00

[52] U.S. Cl. ..... 198/621.1

[58] Field of Search ..... 198/621.1, 621.2, 198/774.1

[56] References Cited

U.S. PATENT DOCUMENTS

| | | | |
|---|---|---|---|
| 4,540,087 | 9/1985 | Mizumoto . | |
| 4,741,195 | 5/1988 | Arai et al. | 198/621.1 X |
| 4,785,657 | 11/1988 | Votava | 198/621.1 X |

FOREIGN PATENT DOCUMENTS

| | | |
|---|---|---|
| 0 224 652 A1 | 6/1987 | European Pat. Off. . |
| 32 38 729 A1 | 5/1983 | Germany . |
| 33 29 900 C2 | 2/1984 | Germany . |
| 34 17 435 A1 | 11/1985 | Germany . |
| 41 01 513 A1 | 8/1991 | Germany . |
| 40 32 340 A1 | 4/1992 | Germany . |
| 41 00 348 A | 7/1992 | Germany . |
| 41 32 221 A1 | 4/1993 | Germany . |
| 59-197325 | 11/1984 | Japan . |

*Primary Examiner*—D. Glenn Dayoan

*Attorney, Agent, or Firm*—Evenson, McKeown, Edwards & Lenahan, P.L.L.C.

[57] ABSTRACT

An apparatus for three-dimensionally driving gripper rails in a multiple-pedestal press has raisable and lowerable guides for moving the gripper rails in a clamping and releasing direction in cross slide supports. The cross slide supports are movable in the clamping and releasing direction. The motion of the gripper rails in the clamping and releasing direction is brought about by a servomotor, which is secured at the level of the cross slide supports and which cooperates, with shaft portions extending from both sides thereof and embodied as spindles, with clasp nuts on the cross slide supports. In addition to the advantage of the direct drive for the clamping and releasing motion of the gripper rails, the region required by the tools in the working stages is utilized for accommodating the servomotors.

2 Claims, 3 Drawing Sheets

THREE-DIMENSIONAL GRIPPER RAIL DRIVE APPARATUS

BACKGROUND AND SUMMARY OF THE INVENTION

The present invention relates to an apparatus for three-dimensional drive of gripper rails which extend horizontally, are spaced parallel to one another and are moved forward and backward by drive means in lock boxes in a transfer direction, up and down in a raising and lowering direction, and toward and away from one another in a clamping and releasing direction.

Gripper rail drive apparatuses in a multiple-pedestal press serve to impart the transfer motion of the sheet-metal parts, lay them in tools, remove them therefrom, and transport the parts to the next machining stage or for removal. The requirement is generally that the motion drive mechanisms of the gripper rails in the three axes (three dimensions) not depend on tracing cam contours. Adjustment of the press to new conditions upon a change of a workpiece or of a tool either required individual cams, or required that maximum travel distances for a single set of cams be used as the point of departure.

DE C2 33 29 900 describes an apparatus for three-dimensional transfer in which the movements of gripper rails in the three axis are effected by servomotors. The servomotors are not located within direct operating range of the gripper rails. Transmission chains and connecting rods are needed; given the high accelerations, such as 16 parts and more per minute, demanded in transfer motions, this leads to axial inaccuracies. The rotary motion of the servomotor for the clamping and releasing motion is transmitted via a rack and pinion connection to slide supports that are movable horizontally and crosswise to the transfer motion. What is described is a drive of the clamping mechanism using a direct voltage servomotor, which is supported outside the housing that makes up the lock box, and whose rotary motion is connected via a reducing gear and a control belt to a cone wheel arrangement. The cone wheel arrangement is located on the underside of the housing and has an output shaft for driving the pinion of the rack and pinion combination for the clamping and releasing motion.

Japanese Patent Document 59-197325 shows the drive of gripper rails that are moved in two axes. The clamping and releasing motion of the gripper rails is effected by a reversible servomotor which is flanged outside a bracket movable horizontally in the transfer direction and at the same time must be movable in the transfer direction with the bracket. The motor shaft is brought to one side out of the motor in the form of a spindle. The spindle has a counterclockwise and a clockwise thread, which cooperate with transversely displaceable slide supports that carry the gripper rails.

The same apparatus as described above are also shown in DE-A1 32 38 729. The servomotors for two movements of the three-dimensional movement drive of the gripper rails are indeed disposed centrally, but below the gripper rails, in a lower part of the lock box.

An object of the present invention is to dispose the motor for the clamping and releasing motions of the gripper rails between the gripper rails and the slide support that carries the gripper rails. Such a configuration utilizes the distances that, because of the size of the tools, the gripper rails would otherwise be unable to cover in the machining stages of the gripper rails upon clamping.

This object has been attained in accordance with the present invention by providing that guides for moving the gripper rails in the transfer direction are supported in cross slide supports movable in the raising and lowering direction; the cross slide supports are supported movably in the clamping and releasing direction in a bracket secured to a frame; a servomotor having a reversible rotation direction is secured in the bracket, a shaft of the servomotor extends on both ends to the outside and is provided with a counterclockwise thread on one end and a clockwise thread on the other end as spindles, and the servomotor is supported at a level of clasp nuts located in the cross slide supports and cooperates therewith for direct drive of the cross slide supports.

The disposition of the motor at the level of gripper rails and slide supports is especially advantageous, because this achieves a direct drive for the clamping and releasing motion. No drive, transmission connecting rods or the like are moved in three axes. A servomotor with a drive shaft on both ends has been integrated into the bracket-like design. Because the apparatus is thus symmetrical, the torsional rigidity is increased. The lock box accordingly forms a complete, functional structural unit.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
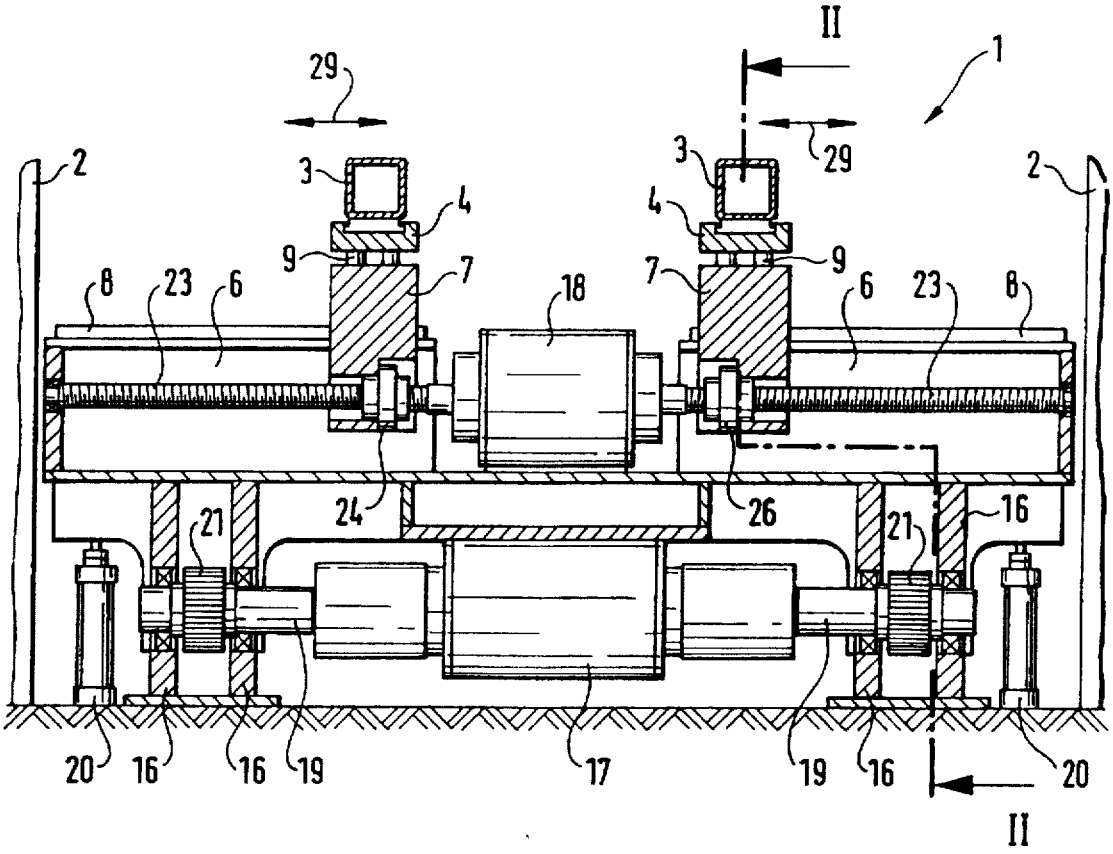
FIG. 1 is an elevational, partially cross-sectional view of a lock box, seen in the transfer direction, with the apparatus according to the present invention.
Figure 2:
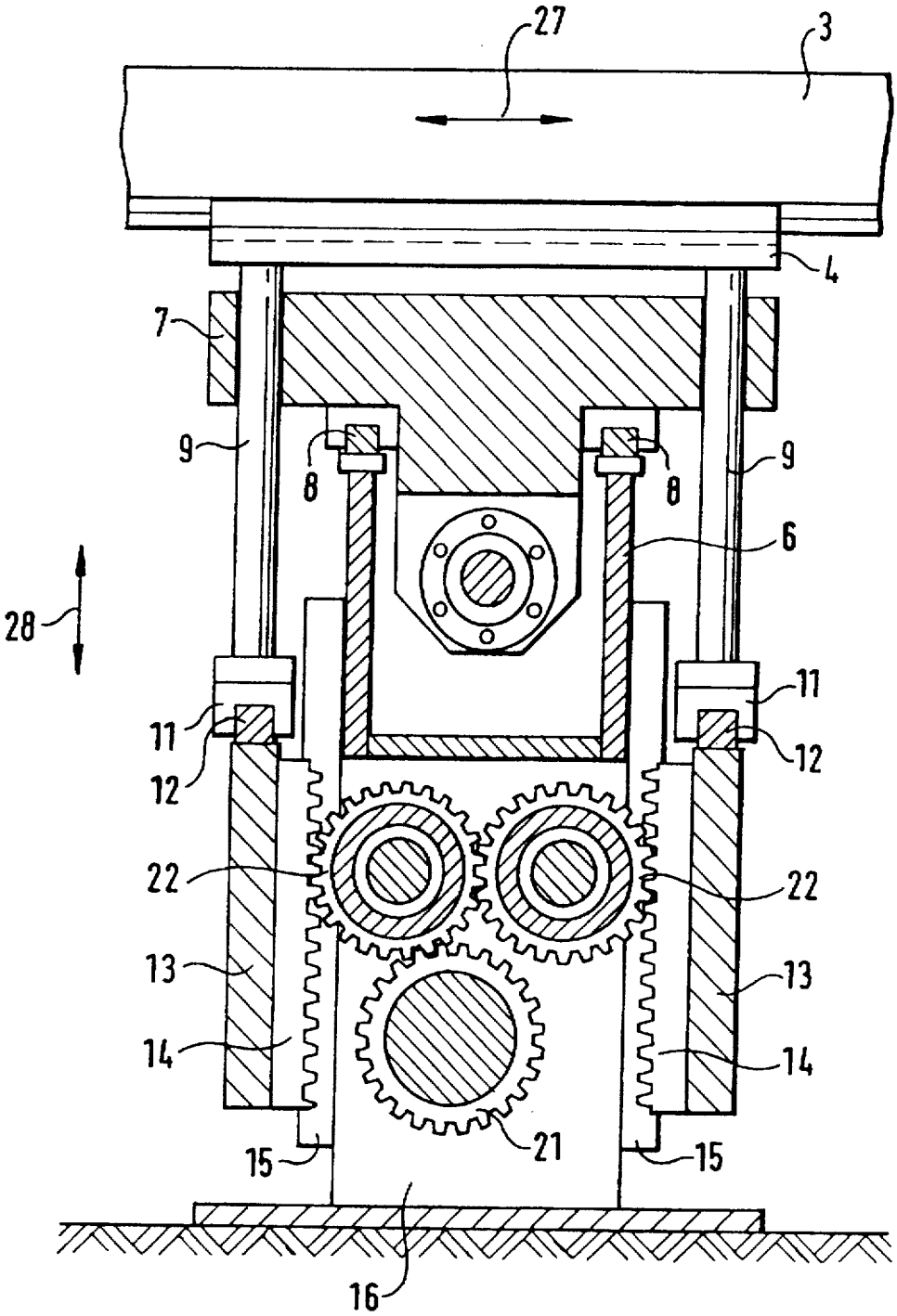
FIG. 2 is a sectional view taken along line II—II of FIG. 1.
Figure 3:
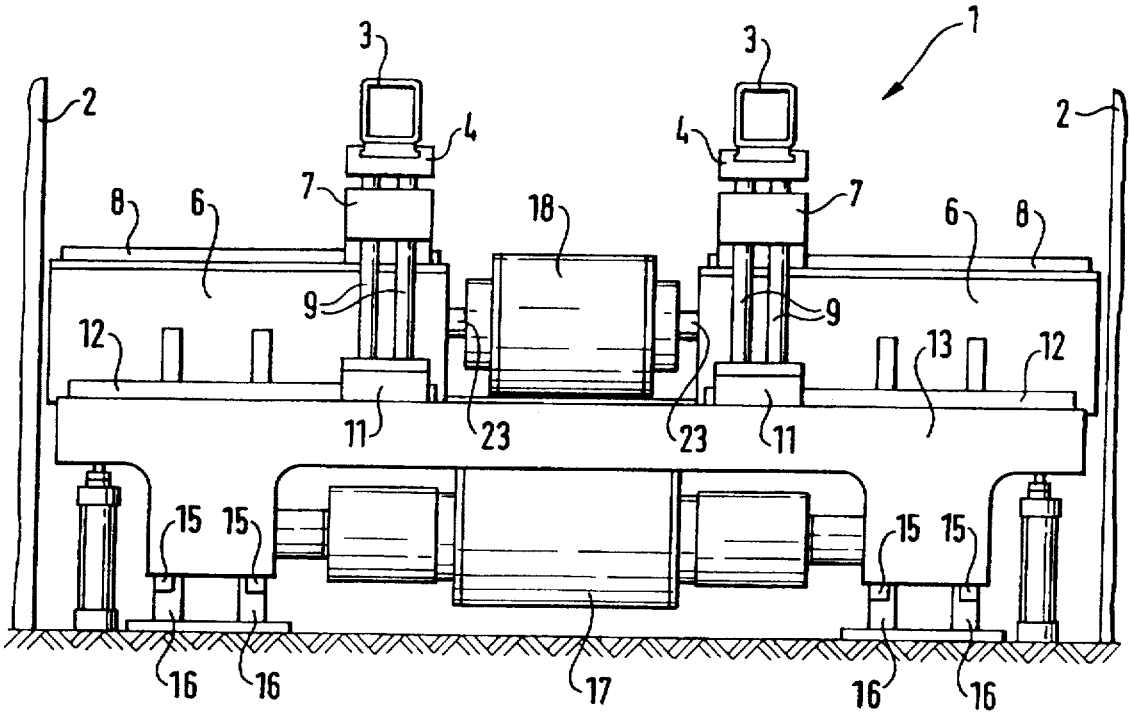
FIG. 3 is an elevational view of the lock box, seen in the transfer direction.

In the drawings, the same numerals are used for identical elements and structural groups. Reference numeral 1 designates generally one lock box of a plurality of lock boxes of a multiple-pedestal press, in position. Of the press, only one pair of pedestals 2, is shown. The lock box 1 is set up on the side toward the press table via metal bracket plates 16. Spur wheels 21 of a motor shaft 19 of a motor 17 for raising and lowering gripper rails 3 are located in the bracket plates 16. As seen in FIG. 2, the spur wheels 21 each cooperate with a spur wheel 22 that acts directly upon a rack 14, guided in bearings 15 toward the frame, and via a further spur wheel 22 on a second rack 14 guided in bearings 15. The rotary motion of the motor 17 is thus converted into a raising and lowering motion (double arrow 28) of metal carrier plates 13. Rails 12 for slide supports 11 that are movable therein crosswise to the transfer direction 27 are secured to the carrier plates 13. The raising and lowering motion of the motor 17 is thus transmitted to the gripper rails 3. The slide supports 11, to that end, carry spacer bolts 9 which are passed upward through cross slide supports 7 and on the upper end thereof carry guides 4 for the gripper rails 3 guided therein. The carrier plates 13 are braced by balancing cylinders 20.

The bracket plates 16 carry a frame 6 in the upper region. The frame 6 is provided with guides 8 in which the cross slide supports 7 are displaceable in the clamping and releasing direction 29. The displacement motions of the cross slide supports 7 are effected by a servomotor 18, which in this layout, is supported at the level of the cross slide supports 7, and whose shaft extends outwardly on both sides of the servomotor. The shaft portions are embodied as spindles 23 provided with a clockwise and a counterclockwise thread, respectively. The threads cooperate with clasp nuts 24, 26, cage nuts or similar spindle nuts in or on the cross slide supports 7. The motion drive of the gripper rails 3 in the transfer direction 27 is effected by way of example in a generally known manner. The raising and lowering motion of the gripper rails 3 is effected, beginning at the motor 17, motor shaft 19 and spur wheel, rack and pinion drive 21, 22, 14 and slide support 11, by the spacer bolts 9 on the guides 4. For that purpose, the guides 12 for the slide supports 11 must extend over the clamping and releasing motion distance of the gripper rails 3. The guides 8 are configured in the same way.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An apparatus for three-dimensional drive of multiple-pedestal press gripper rails which extend horizontally, are spaced parallel to one another and are arranged to move forward and backward in a transfer direction, up and down in a raising and lowering direction, and toward and away from one another in a clamping and releasing direction, wherein guides for moving the gripper rails in the transfer direction are supported in cross slide supports movable in the raising and lowering direction; the cross slide supports are supported movably in the clamping and releasing direction in a bracket; a servomotor having a reversible rotation direction is secured in the bracket, a shaft of the servomotor extends on both ends thereof to the outside and has a counterclockwise thread on one end and a clockwise thread on another end, and the servomotor is operatively associated with clasp nuts for direct drive of the cross slide supports.

2. The apparatus of claim 1, wherein the servomotor is arranged at a level of and between the cross slide supports.

* * * * *